US008053027B2

(12) United States Patent
Cole

(10) Patent No.: US 8,053,027 B2
(45) Date of Patent: Nov. 8, 2011

(54) METHODS FOR FABRICATION OF THIN FILM COMPOSITIONALLY STRATIFIED MULTI-LAYER HETEROSTRUCTURES FOR TEMPERATURE INSENSITIVE LOW DIELECTRIC LOSS AND ENHANCED TUNABILITY OTM COMMUNICATIONS DEVICES

(75) Inventor: Melanie Will Cole, Churchville, MD (US)

(73) Assignee: The United States of America as represented bt the Secretary of the Army, Washington, DC (US)

( * ) Notice: Subject to any disclaimer, the term of this patent is extended or adjusted under 35 U.S.C. 154(b) by 88 days.

(21) Appl. No.: 12/132,684

(22) Filed: Jun. 4, 2008

(65) Prior Publication Data

US 2009/0022971 A1 Jan. 22, 2009

Related U.S. Application Data

(60) Provisional application No. 60/950,041, filed on Jul. 16, 2007.

(51) Int. Cl.
*B05D 5/12* (2006.01)

(52) U.S. Cl. ..... 427/100; 427/126.3

(58) Field of Classification Search ..... 427/100, 427/126.3

See application file for complete search history.

(56) References Cited

U.S. PATENT DOCUMENTS 5,312,790 A 5/1994 Sengupta et al.
5,645,634 A 7/1997 Ogi et al.
5,693,429 A * 12/1997 Sengupta et al. ..... 428/699
5,766,697 A 6/1998 Sengupta et al.
5,830,591 A 11/1998 Sengupta et al.
5,846,893 A 12/1998 Sengupta et al.
6,096,127 A 8/2000 Dimos et al.
6,514,895 B1 2/2003 Chiu et al.

(Continued)

FOREIGN PATENT DOCUMENTS

WO WO 01/18830 A1 3/2001

OTHER PUBLICATIONS

Mohammed et al. Temperature dependence of conventional and effective pyroelectric coefficients for compositionally graded . . . J. App. Phys. 84(6):3322-3325 (Sep. 15, 1998).

(Continued)

*Primary Examiner* — Brian K Talbot
(74) *Attorney, Agent, or Firm* — Avrom David Spevack; Christos S. Kyriakou

(57) ABSTRACT

A compositionally stratified multi-layer $Ba_{1-x}Sr_xTiO_3$ (BST) heterostructure material is described which includes a lower layer of crystallized $Ba_{1-x}Sr_xTiO_3$ perovskite oxide where x is in the range of 0.36-0.44, inclusive, deposited on a substrate; an intermediate layer of crystallized $Ba_{1-x}Sr_xTiO_3$ perovskite oxide where x is in the range of 0.23-0.27, inclusive, in contact with the lower layer; and an upper layer of crystallized $Ba_{1-x}Sr_xTiO_3$ perovskite oxide where x in the range of 0.08-0.13, inclusive, in contact with the intermediate layer. A phase shifter and/or preselector tunable device including a compositionally stratified multi-layer BST heterostructure material is described according to the present invention. Temperature sensitivity of an inventive phase shifter is reduced by at least 70% in the temperature interval of 20 to 90° C., inclusive, and by at least 14% in the temperature interval of −10 to 20° C., inclusive, compared to a compositionally homogeneous 60/40 BST material.

6 Claims, 7 Drawing Sheets

U.S. PATENT DOCUMENTS 6,803,071 B1 * 10/2004 Cole ..... 427/126.3
6,803,134 B1 10/2004 Cole et al.
7,074,507 B2 7/2006 Maria et al.

OTHER PUBLICATIONS

Zhai et al. Nonlinear behaviors of the compositionally graded (Ba,Sr)TiO3 thin films derived by a sol-gel process. Appl. Phys. Lett. 84(7):1162-1164 (Feb. 16, 2004).

Zhu et al. A comparative microstructural study of compositionally up- and down-graded (Ba, Sr) TiO3 thin films epitaxially grown on (La, . . . Appl. Phys. A 82:709-713 (2006).

Zhu et al. Microstructure of compositionally-graded (Ba1-xSrx)TiO3 thin films epitaxially grown on La0.5Sr0.5CoO3-covered (100) LaAlO3 . . . J. Appl. Phys. 97, 093503 (2005).

Zhu et al. Epitaxial growth and dielectric properties of functionally graded (Ba1-xSrx)TiO3 thin films with . . . J. Vac. Sci. Technol. A 20(5):1796-1801 (Sep. 10, 2002).

* cited by examiner

METHODS FOR FABRICATION OF THIN FILM COMPOSITIONALLY STRATIFIED MULTI-LAYER HETEROSTRUCTURES FOR TEMPERATURE INSENSITIVE LOW DIELECTRIC LOSS AND ENHANCED TUNABILITY OTM COMMUNICATIONS DEVICES

REFERENCE TO RELATED APPLICATION

This application claims priority from U.S. Provisional Patent Application Ser. No. 60/950,041, filed Jul. 16, 2007, the entire content of which is incorporated herein by reference.

GOVERNMENT INTEREST

The invention described herein may be manufactured and used by or for the Government of the United States of America for government purposes without the payment of any royalties therefore.

FIELD OF THE INVENTION

This invention relates generally to tunable device material for attaining temperature stable operation with enhanced tuning and low dielectric loss. More specifically, the present invention relates to a compositionally stratified multi-layered $Ba_{1-x}Sr_xTiO_3$ material, apparatus incorporating the material and methods for fabrication and use thereof.

BACKGROUND OF THE INVENTION $Ba_{1-x}Sr_xTiO_3$ (BST) in thin film form is an important material for utilization in tunable microwave devices, such as filters and phase shifters. For these tunable microwave devices, high dielectric tunability, low microwave loss, and good temperature stability are required for optimum performance and long-term reliability. The current generation of tunable microwave phase shifter devices is based on single composition, paraelectric $Ba_{1-x}Sr_xTiO_3$ films, and the military and commercial end-users have expressed significant concern that in practical applications, e.g., On-The-Move (OTM) phased array antennas, the phase shifter performance will be compromised due to the temperature dependence of the device capacitance. Specifically, the capacitance of the BST based device is strongly influenced by temperature changes because the dielectric constant ($\in_r$) of a single composition paraelectric BST films (e.g. $Ba_{0.5}Sr_{0.5}TiO_3$) follows the Curie-Weiss law;

$$K=C_{curie}/(T-\theta) \quad (1)$$

where K is the dielectric constant $C_{curie}$ is the curie constant, T is the temperature, and θ is the Curie temperature. Spurious changes in the device capacitance that stem from ambient temperature fluctuations will disrupt the phase shifter performance via device-to-device phase shift and/or insertion loss variations leading to beam pointing errors and ultimately communication disruption and/or failure in the ability to receive and transmit the information. The same is true for BST based tunable filters where the capacitance susceptibility to temperature changes results in the alteration of the band pass window sharpness (window narrows or broadens), or the entire band pass window may shift to higher or lower frequencies and/or the insertion loss may be degraded. Such poor temperature stability of the capacitance would result in the carrier signal drifting in and out of resonance on hot and cold days.

Traditional approaches to address the issue of device (phase shifter and/or tunable filter) temperature instability have focused on employing hermetic or robust packaging, whereby the robust package serves to protect the tunable device from the harsh environmental extremes. Although this approach is successful, hermetic/robust packaging would add significant cost, size, and weight to these OTM phased array antennas, which in turn violates the military and commercial sectors requirements for affordability. It is not foreseeable that such an approach could meet the criteria of a low cost phase shifter i.e. ~$5.00 per phase shifter element. Other concepts to achieve temperature stability compliance, involve the use of "system heat sinks" and/or cooling apparatuses such as "mini fans" and/or "temperature compensation circuits" or "mini ovens-heating units". Such thermal management solutions (fans/heat sinks/ovens and various other types of thermal management) may be utilized with the OTM antennas: however they will add extra weight, size, and cost to the overall system, and as such, are deemed unacceptable. Temperature compensation can also be achieved using either the (1) curve fit or (2) look up table approach. The curve fit approach centers on the formulation of a temperature dependant mathematical expression/equation, which represents the drift of each BST tunable device. A microprocessor utilizes this equation and the ambient temperature data (obtained from a thermocouple mounted on the printed circuit board) to calculate the tuning voltage. The look-up table approach, as its name implies involves using a look up table. In order to obtain the look-up table coefficients, the phase shifter characteristics must be measured at discrete temperatures then the BST bias voltage is manually adjusted to maintain the phase shifter specifications. In the worst-case scenario, one would have to obtain a set of points for each temperature (i.e., 23° C., 24° C. etc.). Typically one would expect to have a small subset of temperature/bias points for each bias line. The exact number of points is of course dependent on the BST devices, the other phase shifter components, and the phase shifter topology. Unfortunately, this approach can be quite complex as there usually isn't a one size fits all solution. The calibrations are also labor and time intensive and are useful if only a limited number of OTM phased array antennas are to be fielded. Common-place materials science approaches for reducing the temperature dependence of an active material have been to select the temperature interval of operation well above the temperature corresponding to the active materials permittivity maximum. Unfortunately, this method results in reduced material tunability and the temperature coefficient of capacitance (TCC) is still too high for practical military applications such as OTM phased array antennas.

Thus the development of a temperature stable phase shifter/filter technology capability is paramount, as it ensures uninterrupted reliable information exchange via On-The-Move communications systems in harsh temperature environments.

Thus, there is a continuing need for a temperature stable material that possesses low dielectric loss and high tunability, particularly for use in phase shifting and/or tunable preselector (filter) devices for communications systems, as well as methods for fabrication of such temperature stable enhanced property materials.

SUMMARY OF THE INVENTION

A compositionally stratified perovskite oxide multilayer heterostructure material is provided according to the present invention which includes a lower layer of crystallized $Ba_{1-x}Sr_xTiO_3$ perovskite oxide where x is in the range of 0.36-0.44, inclusive, deposited on a substrate; an intermediate layer of crystallized $Ba_{1-x}Sr_xTiO_3$ perovskite oxide where x is in the range of 0.23-0.27, inclusive, in contact with the lower layer; and an upper layer of crystallized $Ba_{1-x}Sr_xTiO_3$ perovskite oxide where x in the range of 0.08-0.13, inclusive, in contact with the intermediate layer. Each of the lower, intermediate and upper layers includes crystallized $Ba_{1-x}Sr_xTiO_3$ perovskite oxide having no preferred crystallographic orientation in preferred embodiments of the present invention. Each of the lower, intermediate and upper layers is in the form of a thin film having a thickness in the range of about 10 nm-500 nm, inclusive. Each of the lower, intermediate and upper layers has a longest dimension generally parallel to the substrate and a thickness generally perpendicular to the substrate, the longest dimension greater than the thickness.

A compositionally stratified perovskite oxide multilayer heterostructure material of the present invention has a dielectric constant lower than 500.

One or more electrical contacts, such as an electrode, is disposed between the substrate and the lower layer and/or in contact with the upper layer.

The heterostructure material is effective to maintain a permittivity of less than 500 within the temperature interval of −10 to 90° C., inclusive. Further, the heterostructure material is effective to reduce the dielectric loss by at least 50% over the temperature interval of −10 to 90° C., inclusive, compared to a uniform composition $Ba_{0.6}Sr_{0.4}TiO_3$ perovskite oxide.

An inventive heterostructure material is effective to elevate the dielectric tunability by at least 58% over the temperature interval of −10 to 90° C., inclusive, compared to a uniform composition $Ba_{0.6}Sr_{0.4}TiO_3$ perovskite oxide.

The substrate is a single crystal high resistivity silicon (100) material in a particular embodiment of the present invention.

An embodiment of a compositionally stratified BST multilayer heterostructure material of the present invention includes a lower layer which is crystallized $Ba_{0.6}Sr_{0.4}TiO_3$ perovskite oxide on a substrate; an intermediate layer which is crystallized $Ba_{0.75}Sr_{0.25}TiO_3$ perovskite oxide; and an upper layer which is crystallized $Ba_{0.9}Sr_{0.1}TiO_3$ perovskite oxide.

A method of fabricating a compositionally stratified perovskite oxide multi-layer heterostructure material is described herein including depositing $Ba_{1-x}Sr_xTiO_3$ perovskite oxide, where x is in the range of 0.36-0.44, inclusive, on a substrate; crystallizing the $Ba_{1-x}Sr_xTiO_3$ perovskite oxide, where x is in the range of 0.36-0.44, inclusive, producing a lower layer; depositing $Ba_{1-x}Sr_xTiO_3$ perovskite oxide where x is in the range of 0.23-0.27, inclusive, onto the lower layer; crystallizing the $Ba_{1-x}Sr_xTiO_3$ perovskite oxide where x is in the range of 0.23-0.27, inclusive, producing an intermediate layer; depositing $Ba_{1-x}Sr_xTiO_3$ perovskite oxide where x in the range of 0.08-0.13, inclusive, onto the intermediate layer; and crystallizing the $Ba_{1-x}Sr_xTiO_3$ perovskite oxide where x in the range of 0.08-0.13, inclusive, producing an upper layer, the upper layer having a bottom surface in contact with the intermediate layer and an opposing top surface.

Optionally, a bottom electrode is disposed on the substrate prior to deposition of the lower layer. In a further option, a top electrode is disposed in electrical communication with the top surface of the upper layer.

In a further option, an adhesion material is disposed between the substrate and the bottom electrode. In a specific example, a Ti layer is included as an adhesion material.

The crystallizing step includes thermal treatment at temperature of about 750° C. for about 60 min. in oxygen ambience in particular embodiments of a method of the present invention.

The depositing preferably includes metallorganic solution deposition.

A vertical, that is, a parallel plate capacitor or varactor phase shifter device is provided according to embodiments of the present invention which includes the compositionally stratified perovskite oxide multilayer heterostructure material described herein. A coplanar phase shifter device is provided according to embodiments of the present invention which includes the compositionally stratified perovskite oxide multilayer heterostructure material described herein.

In a particular embodiment of the present invention, a compositionally stratified perovskite oxide multilayer heterostructure material includes a lower layer of crystallized $Ba_{1-x}Sr_xTiO_3$ perovskite oxide where x is in the range of 0.36-0.44, inclusive, deposited on a substrate; an intermediate layer of crystallized $Ba_{1-x}Sr_xTiO_3$ perovskite oxide where x is in the range of 0.23-0.27, inclusive, in contact with the lower layer; and an upper layer of crystallized $Ba_{1-x}Sr_xTiO_3$ perovskite oxide where x in the range of 0.08-0.13, inclusive, in contact with the intermediate layer, with the proviso that no $BaTiO_3$ layer is disposed in contact with the upper layer.

DETAILED DESCRIPTION OF THE INVENTION

Figure 1A:
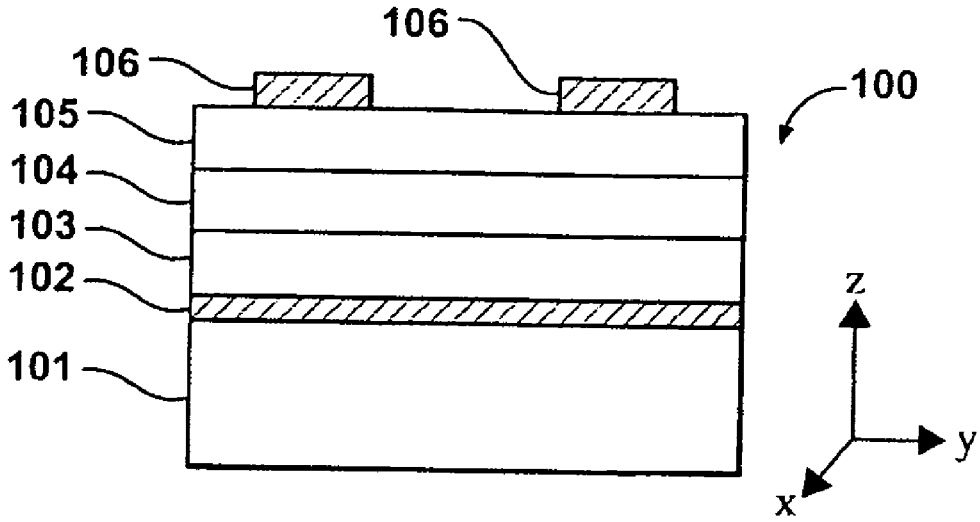
FIG. 1A is a schematic representation of an embodiment of a compositionally stratified BST multilayer heterostructure material according to the present invention; where the material is integrated within a parallel plate varactor device configuration utilizing one or more bottom electrodes and one or more top electrodes.

A compositionally stratified BST multi-layered heterostructure material is provided to mitigate the effect of ambient temperature on sensitive tunable communications device components, such as phase shifters and pre-selector (tunable filter) devices.

A compositionally stratified BST multi-layered heterostructure material of the present invention is characterized by temperature stability over a broad temperature range (−10° C. to 90° C.) while simultaneously achieving enhanced tunability, low loss, and dielectric permittivity values less than 500.

A compositionally stratified perovskite oxide multilayer heterostructure material, is provided according to the present invention which includes a lower layer of crystallized $Ba_{1-x}Sr_xTiO_3$ perovskite oxide where x is in the range of 0.36-0.44, inclusive, deposited on a substrate; an intermediate layer of crystallized $Ba_{1-x}Sr_xTiO_3$ perovskite oxide where x is in the range of 0.23-0.27, inclusive, in contact with the lower layer; and an upper layer of crystallized $Ba_{1-x}Sr_xTiO_3$ perovskite oxide where x in the range of 0.08-0.13, inclusive, in contact with the intermediate layer.

In specific embodiments, a compositionally stratified $Ba_{1-x}Sr_xTiO_3$ (BST) heterostructure material according to the present invention includes a $Ba_{0.60}Sr_{0.40}TiO_3$ (BST 60/40) perovskite oxide layer disposed on a substrate support, a $Ba_{0.75}Sr_{0.25}TiO_3$ (BST 75/25) perovskite oxide layer disposed on the $Ba_{0.60}Sr_{0.40}TiO_3$ (BST 60/40) perovskite oxide layer, and a $Ba_{0.90}Sr_{0.10}TiO_3$ (BST 90/10) perovskite oxide layer disposed on the BST 75/25 perovskite oxide layer.

In specific embodiments of the present invention, each BST perovskite oxide layer is in the form of a thin film having a nominal thickness in the range of about 10 nm to 500 nm, inclusive, more preferably in the range of about 50 nm to 250 nm, inclusive. In specific examples of a compositionally stratified multi-layered BST heterostructure described herein, each layer is a thin film having a thickness of about 70 nm.

In preferred embodiments, no $BaTiO_3$ layer is present in a compositionally stratified multi-layered BST heterostructure of the present invention.

A substrate support may be single crystal low microwave loss substrate such as sapphire $Al_2O_3$, MgO, $LaAlO_3$, GaAs, CeO, high resistivity Si, quartz, glass, fused silica or similar support structures. Optionally, the substrate is purified. An exemplary purification of a substrate includes dipping the substrate in acetone and methanol, followed by a weak HF solution to remove/etch native oxide, and then rinsing in de-ionized (DI) water. Optionally, a thermal oxidation layer is grown on high resistivity silicon for use as a substrate in methods, compositions and apparatus of the present invention.

Optionally, an adhesive is disposed between the lower layer of crystallized BST perovskite oxide and the substrate to promote adhesion of an electrode to the substrate. For example, an adhesion material includes a layer of Ti wherein the Ti layer is positioned adjacent to the substrate. An adhesion layer is disposed between a substrate and a bottom electrode such that the relative order of the layers is: substrate-adhesion layer-bottom electrode-lower layer of the crystallized BST perovskite oxide in particular embodiments of the present invention. The thickness of the adhesion layer can range from 2-40 nm, preferably in the range of 5-20 nm and in a preferred embodiment, the adhesion layer is 10 nm. Additional illustrative adhesion materials are Cr and Pd.

For example, a layer of Ti, Cr or Pd is optionally disposed between a substrate and an electrode such that the relative order of the layers is: substrate—Ti, Cr or Pd adhesion layer-bottom electrode-lower layer of the crystallized BST perovskite oxide in particular embodiments of the present invention.

Generally, each of the BST perovskite oxide layers of a heterostructure material of the present invention has a longest dimension generally parallel to the substrate and a thickness generally perpendicular to the substrate, the longest dimension greater than the thickness.

Optionally, one or more electrodes is disposed in electrical communication with the compositionally stratified multi-layer BST perovskite oxide heterostructure material.

Configurations of the one or more electrodes depends on the intended configuration for use of the compositionally stratified multi-layer BST perovskite oxide heterostructure material of the present invention. For example, in particular embodiments of a parallel plate capacitor/varactor device, one or more "bottom electrodes" is disposed between a substrate support and the lower layer of the compositionally stratified multi-layer BST heterostructure and one or more "top electrodes" is disposed on the top surface of the compositionally stratified multi-layer BST heterostructure. Alternatively, a co-planar device configuration is provided having according to the present invention including a "top electrode" disposed in contact with the top surface of a compositionally stratified multi-layer BST heterostructure disclosed herein. In particular embodiments, an electrode including one or more noble metals is used, such as a Pt electrode.

FIG. 1A shows a schematic cross-section of a parallel plate varactor device configuration (100) including a compositionally stratified multi-layered BST heterostructure having a lower layer (103) of crystallized $Ba_{1-x}Sr_xTiO_3$ perovskite oxide where x is in the range of 0.36-0.44, inclusive, deposited on a substrate (101); an intermediate layer (104) of crystallized $Ba_{1-x}Sr_xTiO_3$ perovskite oxide where x is in the range of 0.23-0.27, inclusive, in contact with the lower layer (103); and an upper layer (105) of crystallized $Ba_{1-x}Sr_xTiO_3$ perovskite oxide where x in the range of 0.08-0.13, inclusive, in contact with the intermediate layer (104). The heterostructure composite material is in contact with a bottom electrode (102) overlying the substrate support (101) in a parallel-plate varactor device configuration with top electrodes (106). Optionally, an adhesion material such as a layer of Ti is positioned adjacent to the substrate and a bottom electrode.

Figure 1B:
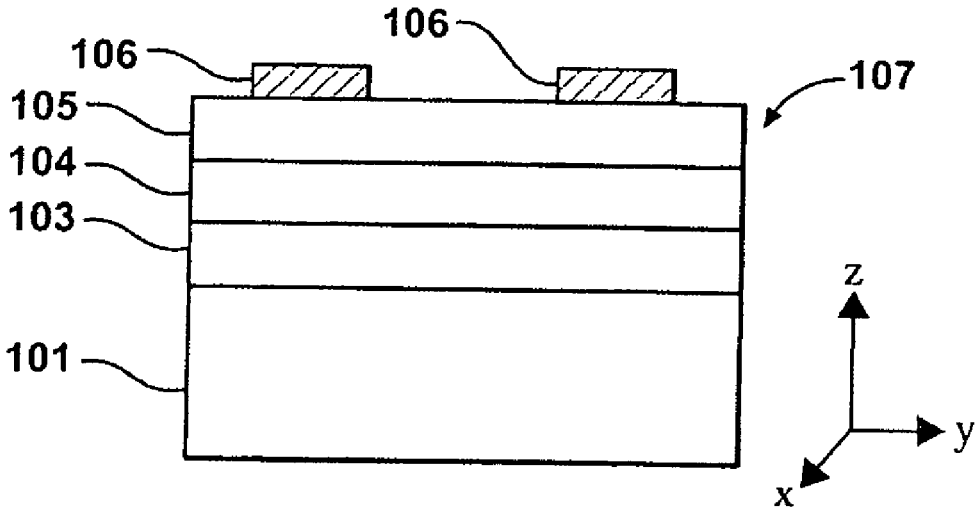
FIG. 1B is a schematic representation of a compositionally stratified BST multilayer heterostructure material integrated in co-planar device configuration in accordance with an embodiment of the invention utilizing only a top electrode.

FIG. 1B shows a schematic cross-section of a coplanar device configuration (107) including a compositionally stratified multi-layered BST heterostructure having a lower layer (103) of crystallized $Ba_{1-x}Sr_xTiO_3$ perovskite oxide where x is in the range of 0.36-0.44, inclusive, deposited on a substrate (101); an intermediate layer (104) of crystallized $Ba_{1-x}Sr_xTiO_3$ perovskite oxide where x is in the range of 0.23-0.27, inclusive, in contact with the lower layer (103); and an upper layer (105) of crystallized $Ba_{1-x}Sr_xTiO_3$ perovskite oxide where x in the range of 0.08-0.13, inclusive, in contact with the intermediate layer (104). The heterostructure composite material is in contact with a substrate support (101) in coplanar device configuration with top electrodes (106).

Tunable communications systems, including "on-the move" (OTM) phased array antennas and mobile radios include a component which is key to the proper function of these systems, the phase shifter and preselector/tunable filter, respectively. The phase shifter/filter performance is severely compromised in harsh temperature environments leading to severely impaired antenna/radio performance. Specifically, for phased array antenna systems, the spurious changes in the device capacitance that stem from ambient temperature fluctuations disrupt the phase shifter performance via device-to-device phase shift and/or insertion loss variations leading to beam pointing errors and ultimately communication disruption and/or failure in the ability to receive and transmit information. Similarly, for OTM radios such changes in the device capacitance leads to alteration of the band pass window sharpness whereby the window narrows or broadens and/or the entire band pass window may shift to higher or lower frequencies, and/or the insertion loss may change, all of which promote communication disruption. Thus, a tunable device, more specifically a phase shifter is provided according to the present invention which includes a compositionally stratified BST heterostructure material described herein. The compositionally stratified BST heterostructure material affords dielectric property temperature stability to the phase shifter and/or preselector device structure exposed to ambient temperatures ranging from −10 to 90° C. Further, the inventive compositionally stratified BST multi-layer heterostructure material reduces susceptibility of undesirable dielectric property sensitivity in tunable communications devices.

Temperature susceptibility in tunable communications devices is quantified in terms of temperature coefficient of capacitance (TCC). TCC is defined according to the equation $TCC=\Delta C(C_0\Delta T)$, where $\Delta C$ is the change in capacitance with respect to $C_0$ at 20° C. and $\Delta T$ is the change in temperature relative to 20° C. In a compositionally stratified BST multi-layer heterostructure material of the present invention, in the temperature interval from 20 to 90° C. the $TCC_{20-90}=-0.921$ ppt/° C. such that the TCC value is lowered by 70% with respect to homogenous uniform composition of BST 60/40, a 3:1 change. Further, in the temperature interval from 20 to −10° C. the $TCC_{20-(10)}=-0.716$ ppt/° C. such that the TCC value is lowered by 14% with respect to the uniform BST60/40 composition.

A compositionally stratified BST multi-layer heterostructure material of the present invention included in a phase shifter/filter device incorporates advantages of a dielectric response of the compositionally stratified perovskite oxide BST materials as a function of temperature which exhibits characteristics of a diffuse phase transformation, which is inherently linked, with the distribution of the phase transformation temperature resulting from the composition gradient across the perovskite oxide material.

An inventive compositionally stratified BST multi-layer heterostructure material included in a phase shifter/filter device confers advantages of high tunability and low dielectric loss by grading the polarization and defect trapping at compositionally distinct interfaces, respectively. Tunability ($\eta$), defined as $\eta=\Delta C/C_0$ where $\Delta C$ is the change in capacitance relative to zero-bias capacitance $C_0$, is an important parameter and is a function of applied bias.

In particular embodiments of a phase shifter or tunable filter device including the compositionally stratified BST multi-layer heterostructure material, dielectric tunability is 65.5% at 444 kV/cm. Specifically, the tunability of a phase shifter or tunable filter device including a compositionally stratified BST multi-layer heterostructure material of the present invention is increased by 56% with respect to that of MOSD fabricated homogenous composition BST60/40. The dielectric loss (tan $\delta$) for the compositionally stratified BST multi-layer heterostructure material is 0.01 and the permittivity is $\in_r=360$. The inventive material possesses a dielectric loss value that is at least 50% lower than that of homogenous uniform composition BST60/40 fabricated by the MOSD technique.

The enhanced elevated tunability at a low applied field shown by a compositionally stratified BST multi-layer heterostructure material is an important result, since in a phase shifter circuit, higher tunability allows for fewer tuning elements which are cascaded to achieve the desired phase shifting. The decrease of the amount of tuning elements directly reduces the net circuit loss. The net decrease in amount of tuning elements lowers the system cost. Lower dielectric loss enhances or maximizes the systems communication signal in both transmit and receive modes.

Figure 8A:
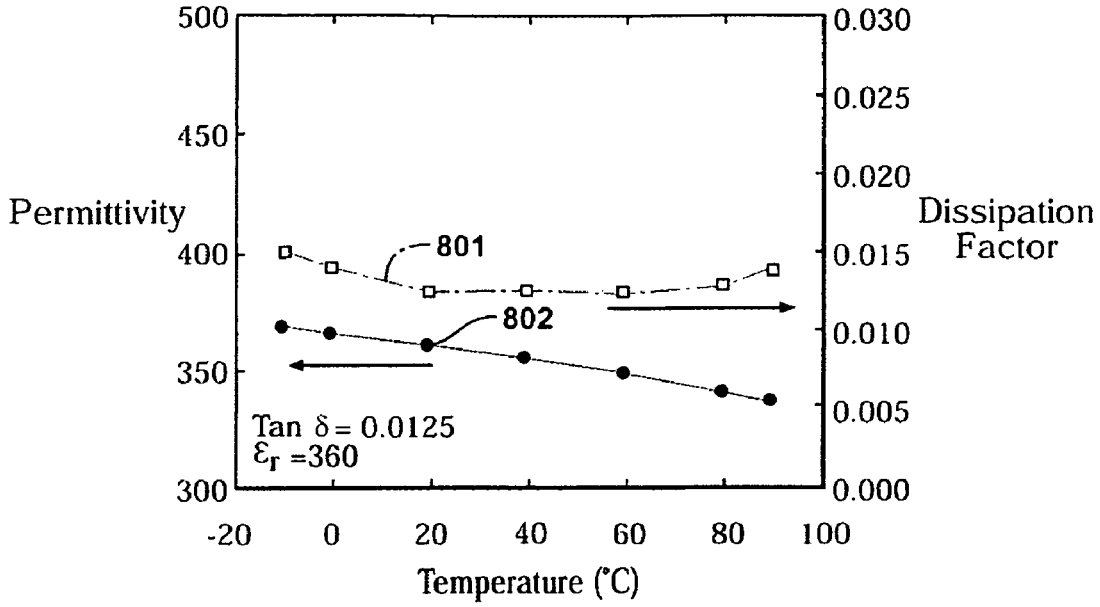
FIG. 8A is graph showing the showing the temperature dependence of the dielectric response for a compositionally stratified BST multilayer heterostructure material. Trace (801) represents the dissipation factor and trace (802) represents the permittivity.

The dielectric loss (phase shifter insertion loss) of inventive compositionally stratified BST multilayer heterostructure material exhibited negligible dispersion over the measured temperature range, −10 to 90° C. (FIG. 8A—trace 801). This is an important result, since in phase shifter devices the loss must be consistent (or predictable) to ensure antenna performance consistency and reliability with respect to variable temperature.

Figure 10:
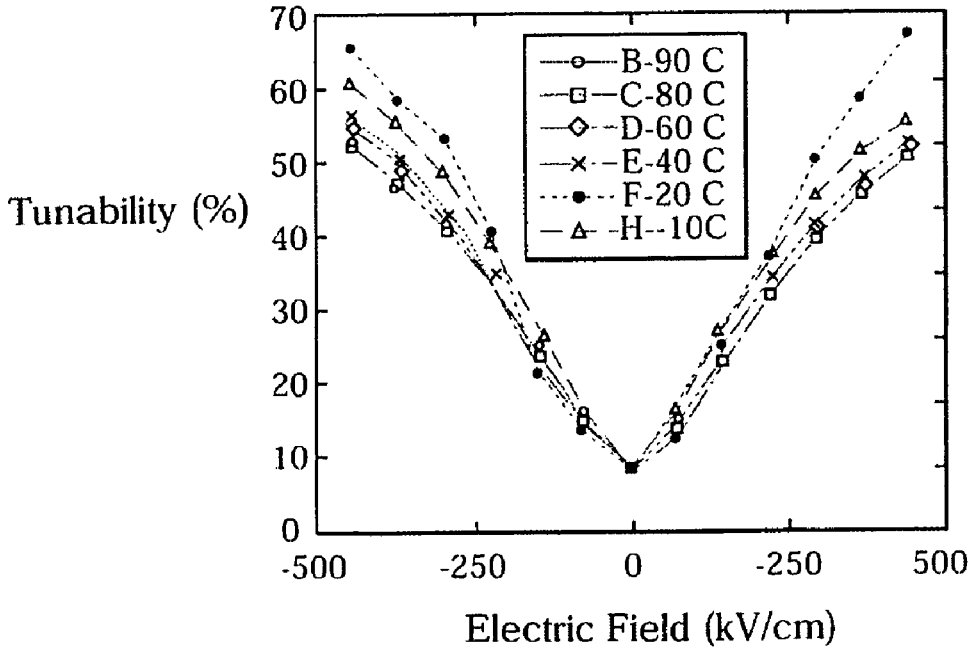
FIG. 10 is a graph showing the temperature dependence of the dielectric tunability for a compositionally stratified multilayer BST multi-layer heterostructure material from 90 to −10° C. The symbols on the graph represent the following temperatures: 90° C. (open circles), 80° C. (open squares) 60° C. (open diamonds), 40° C. (crosses), 20° C. (filled circles), and −10° C. (open triangles).

As shown in measured data graphed in FIG. 10, over the temperature range of −10 to 90° C., tunability is not significantly modified, i.e. the bias-tunability trends are temperature independent. This result is significant, as the voltage tunable phase shifter devices are expected to be operated in environments with different ambient temperatures with excellent reliability and accuracy.

In particular embodiments, an inventive compositionally stratified multi-layer BST heterostructure material is effective to sustain temperature stability over bias ranges of 0 to 444 kV/cm in the range of about 10 kHz to about 30 GHz with a dissipation value less than 2%.

Methods of Fabrication

A method of fabricating a compositionally stratified multi-layer BST heterostructure material is provided according to embodiments of the present invention which includes depositing $Ba_{1-x}Sr_xTiO_3$ perovskite oxide, where x is in the range of 0.36-0.44, inclusive, on a substrate; crystallizing the $Ba_{1-x}Sr_xTiO_3$ perovskite oxide, where x is in the range of 0.36-0.44, inclusive, producing a lower layer; depositing $Ba_{1-x}Sr_xTiO_3$ perovskite oxide where x is in the range of 0.23-0.27, inclusive, onto the lower layer; crystallizing the $Ba_{1-x}Sr_xTiO_3$ perovskite oxide where x is in the range of 0.23-0.27, inclusive, producing an intermediate layer; depositing $Ba_{1-x}Sr_xTiO_3$ perovskite oxide where x in the range of 0.08-0.13, inclusive, onto the intermediate layer; and crystallizing the $Ba_{1-x}Sr_xTiO_3$ perovskite oxide where x in the range of 0.08-0.13, inclusive, producing an upper layer, the upper layer having a bottom surface in contact with the intermediate layer and an opposing top surface.

Deposition of the perovskite oxide thin film materials is by any of various deposition techniques, illustratively including metalorganic solution deposition (MOSD), sputtering, metal-organic chemical vapor deposition (MOCVD), molecular beam epitaxy (MBE) and pulsed laser deposition (PLD).

Figure 2:
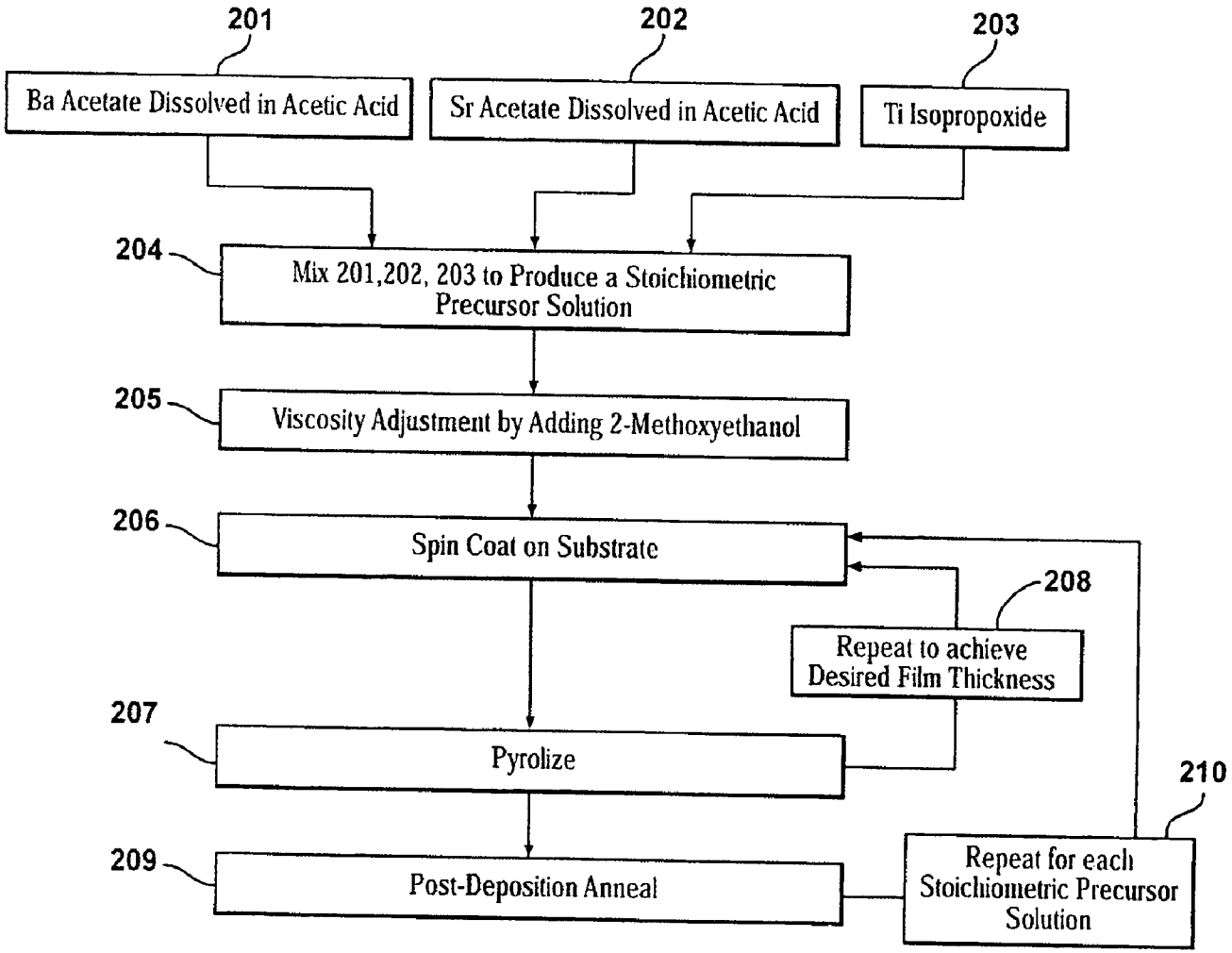
FIG. 2 is a flow diagram illustrating a process for fabricating a compositionally stratified BST multi-layer heterostructure material according to an embodiment of the present invention.

In a preferred embodiment, deposition of the perovskite oxide thin film materials is achieved via the MOSD technique as shown schematically in FIG. 2. Barium acetate ($Ba(CH_3COOH)_2$) dissolved in acetic acid, 201, strontium acetate ($Sr(CH_3COOH)_2$) dissolved in acetic acid, 20, and titanium (IV) isopropoxide ($Ti(C_4H_9O)_4$), 203, are precursors mixed in specified proportions to form a stoichiometric precursor solution, 204, which is then deposited to form the BST film layers. Glacial acetic acid and 2-methoxyethanol ($H_3COOH_2CH_2OH$) are used as solvents. Particulates are removed from the solution by filtering through 0.2 μm syringe filters. The viscosity and surface tension of the precursor solution may be adjusted using 2-methoxyethanol ($H_3COOH_2CH_2OH$), 205.

A first BST stoichiometric precursor solution is deposited on a substrate support using the MOSD technique by spin-on film coating, 206, in particular embodiments of the present invention. Following deposition, pyrolysis, 207, is performed at a temperature and for a time sufficient to remove organic addenda. For example, the deposited BST stoichiometric precursor solution is pyrolyzed at a temperature in the range of about 300 and 400° C., inclusive for a time in the range of about 10-30 min, inclusive. Spin-on film coating and pyrolysis is repeated until the desired film thickness is achieved, 208. Subsequent to deposition and pyrolysis of a BST stoichiometric precursor solution, crystallinity is achieved via post-deposition annealing, 209, using a quartz tube furnace in a flowing oxygen ambience at a temperature in the range of about 700 to 1000° C., inclusive, for a time in the range of about 30 minutes to several hours, inclusive. Post-deposition anneal is preferably preformed for each layer, 210, after pyrolysis. In preferred embodiments, post-deposition annealing is performed in a flowing oxygen ambience at a temperature in the range of about 725 to 775° C., inclusive, for a time in the range of about 45 minutes to 75 minutes, inclusive. In further preferred embodiments, post-deposition annealing is performed in a flowing oxygen ambience at a temperature of about 750° C. for about 60 minutes, inclusive. Detection of annealing, complete film crystallization is achieved, for instance, by film characterization via x-ray diffraction. A fully annealed film is achieved where x-ray spectra show good crystallinity, that is, the x-ray peaks possess high intensity and good definition. An inventive method of fabrication for a compositionally stratified multi-layer BST heterostructure allows compositionally distinct layers to be maintained without inter-diffusion of the constituent elements between the individual layers.

Film thickness is measured by any of various techniques, illustratively including Rutherford backscattering spectroscopy (RBS), cross-sectional field emission scanning electron microscopy (FESEM) and cross-sectional transmission electron microscopy (X-TEM).

A compositionally stratified multi-layer BST heterostructure material of the present invention is integrated into a phase shifter and/or preselector device. In a particular example, of a temperature stable, high tunability compositionally stratified multi-layer BST material according to the present invention is integrated into a generic phase shifter device. For example, a generic phase shifter device includes a varactor structure with a compositionally stratified multi-layer BST heterostructure material of the present invention sandwiched between a top and bottom electrode; such a device structure is based on a parallel plate capacitor configuration.

A phase shifter device including a compositionally stratified multi-layer BST heterostructure material is described according to the present invention. Temperature sensitivity of an inventive phase shifter is reduced by at least 70% in the temperature interval of 20 to 90° C., inclusive, and by at least 14% in the temperature interval of −10-20° C., inclusive, compared to a compositionally homogeneous 60/40 BST material.

EXAMPLES

Example 1

Three precursor solutions: barium acetate ($Ba(CH_3COOH)_2$) dissolved in acetic acid, strontium acetate ($Sr(CH_3COOH)_2$) dissolved in acetic acid, and titanium (IV) isopropoxide ($Ti(C_4H_9O_3)_4$) are mixed to form stoichiometric precursor solutions $Ba_{0.60}Sr_{0.40}TiO_3$ (BST60/40), $Ba_{0.75}Sr_{0.25}TiO_3$ (BST75/25), and $Ba_{0.90}Sr_{0.10}TiO_3$ (BST 90/10). Glacial acetic acid and 2-methoxyethanol ($H_3COOH_2CH_2OH$) are used as solvents. Particulates are removed from the solution by filtering through 0.2 μm syringe filters. The viscosity and surface tension of the precursor solutions are adjusted using 2-methoxyethanol ($H_3COOH_2CH_2OH$.

A single crystal high resistivity Si wafer underlying a $SiO_2$ layer, a Ti adhesion layer and a 200 nm thick Pt bottom electrode is used as a substrate support in the following configuration, Si wafer/$SiO_2$/Ti/Pt, in a particular example.

The $Ba_{0.60}Sr_{0.40}TiO_3$ (BST60/40) stoichiometric precursor solution is deposited by spin-on film coating and then pyrolyzed at 350° C. for 10 min. The spin-on film coating and pyrolysis at 350° C. for 10 min is repeated two more times to achieve a film thickness of 70 nm for the $Ba_{0.60}Sr_{0.40}TiO_3$ (BST60/40) layer deposited on the substrate support.

The $Ba_{0.75}Sr_{0.25}TiO_3$ (BST75/25) stoichiometric precursor solution is deposited by spin-on film coating and then pyrolyzed at 350° C. for 10 min. The spin-on film coating and pyrolysis at 350° C. for 10 min is repeated two more times to achieve a film thickness of 70 nm for the $Ba_{0.75}Sr_{0.25}TiO_3$ (BST75/25) layer deposited on the $Ba_{0.60}Sr_{0.40}TiO_3$ (BST60/40) layer.

The $Ba_{0.90}Sr_{0.10}TiO_3$ (BST90/10) stoichiometric precursor solution is deposited by spin-on film coating and then pyrolyzed at 350° C. for 10 min. The spin-on film coating and pyrolysis at 350° C. for 10 min is repeated two more times to achieve a film thickness of 70 nm for the $Ba_{0.90}Sr_{0.10}TiO_3$ (BST90/10) layer deposited on the $Ba_{0.75}Sr_{0.25}TiO_3$ (BST75/25) layer.

Subsequent to deposition and pyrolysis of the BST stoichiometric precursor solution crystallinity of the layer is achieved via post-deposition annealing using a quartz tube furnace in a flowing oxygen ambience at 750° C. for 60 minutes. This is repeated for each compositionally distinct layer. Thus, the compositionally stratified multi-layer BST heterostructure material in this Example undergoes three post-deposition anneals at 750° C., such that each distinct layer composition is fully crystallized prior to the deposition of the next BST stoichiometric precursor solution.

Example 2

Figure 3:
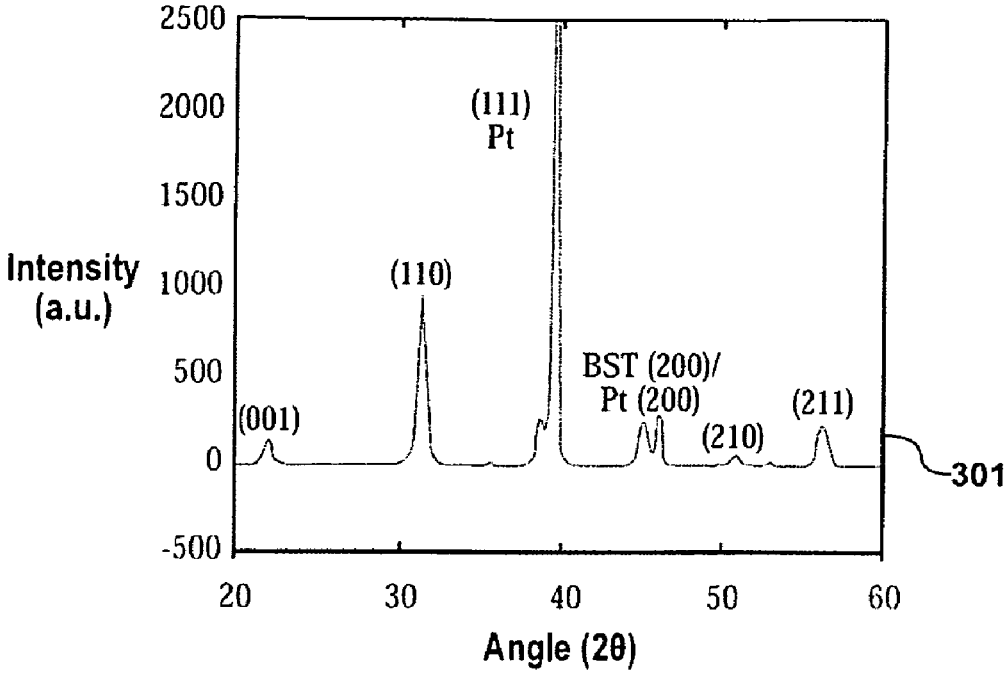
FIG. 3 is a graph showing a glancing x-ray diffraction pattern of annealed metallorganic solution deposition (MOSD) fabricated BST heterostructure material (trace 301) included in an embodiment of the present invention.

FIG. 3 displays the GAXRD pattern of the compositionally stratified BST heterostructure material described in Example 1 (trace 301). The inventive compositionally stratified BST multi-layer heterostructure material exhibits a random polycrystalline perovskite structure. There is no evidence of secondary phase formation, as no peaks other than the peaks of (100), (110), (111), (200), (210), and (211) BST are observed. The lattice parameter of the inventive heterostructure was a=3.9875 Angstrom (Å), which is slightly larger than that for the uniform composition BST film ($a_{uniform\ BST}$=3.964 Angstrom (Å)). This larger lattice parameter of the inventive multilayer BST material is explained by the fact that the lattice parameter of the multilayer structure is an average of the individual lattice parameters of each compositional layer whereby the lattice parameter increases as the Ba/Sr ratio is increased from the first compositional layer, BST60/40 ($a_{BST60/40}$=3.9650 Angstrom (Å)) to that of the surface compositional layer, BST90/10 ($a_{BST90/10}$=$b_{BST90/10}$=3.98 Angstrom (Å), and $c_{BST90/100}$=4.01 Angstrom (Å)).

Example 3

Figure 4A:
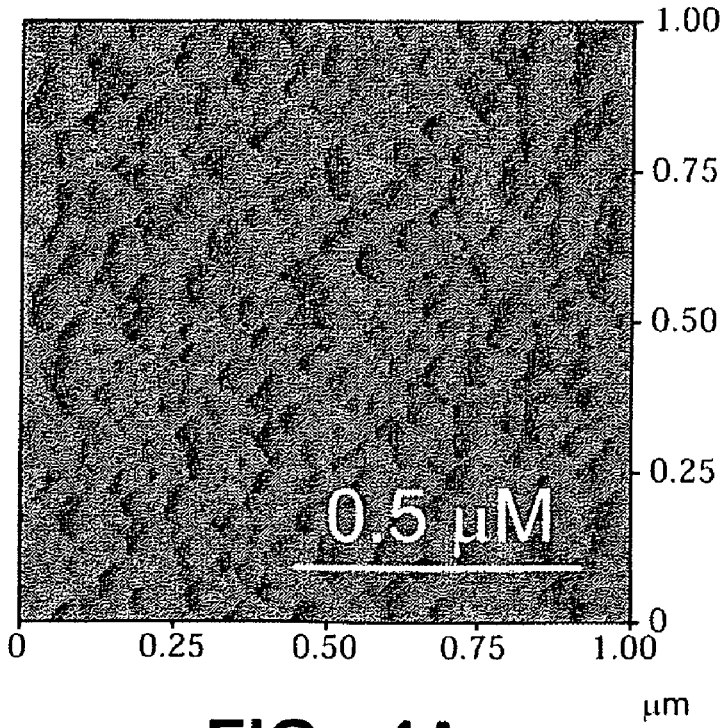
FIG. 4A is a reproduction of a plan-view atomic force microscope (AFM) micrograph, in which the scanned area was 1 $um^2$, showing the surface morphology of 750° C. annealed BST multi-layer heterostructure material of the present invention.
Figure 4B:
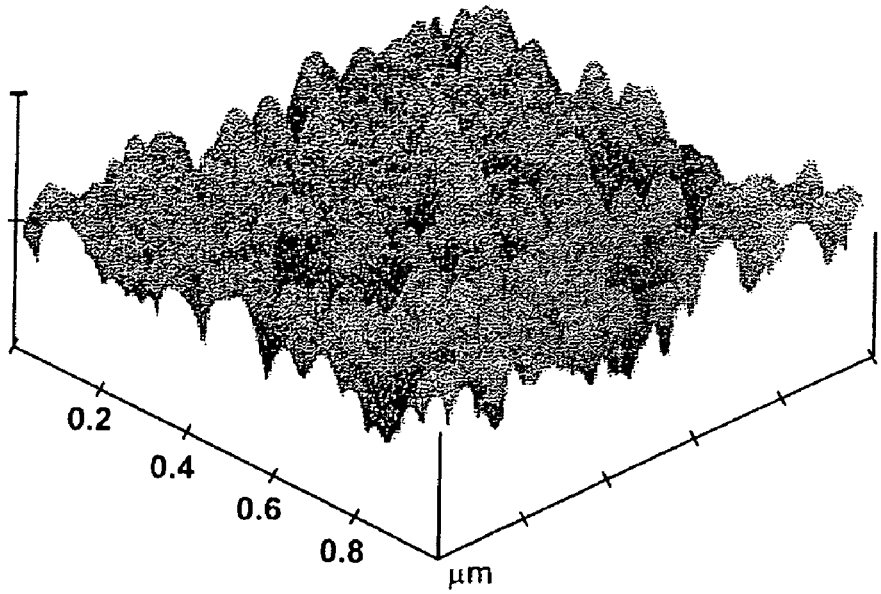
FIG. 4B is a reproduction of a 3-D AFM micrograph showing surface morphology of 750° C. annealed BST multi-layer heterostructure material of the present invention.

Surface morphology of the compositionally stratified BST multi-layer heterostructure material of Example 1 is shown in FIGS. 4A and 4B. The parameter of film surface roughness is important since the dielectric properties are strongly influenced by the quality of the interface between the top electrode and the film. Film-electrode interface roughness exacerbates the leakage characteristics, thereby resulting in reliability and lifetime issues. The smooth defect free surface morphology observed for the BST heterostructure, promotes intimate contact between the film and top electrode metallization, resulting in low conductor loss and low leakage characteristics, and hence is compliant with the systems specifications for ensuring long-term reliability. The atomic force microscopy (AFM) images of the inventive compositionally stratified BST multi-layer heterostructure material's top surface (BST 90/10) demonstrate that the inventive compositionally stratified BST heterostructure possesses a uniform dense microstructure with out cracks, pin-holes, or other surface defects; and a uniform grain size of ~80 nm. The surface roughness, as quantified by AFM is found to be 3.479 nm which is within tunable device design specifications.

Example 4

Figure 5:
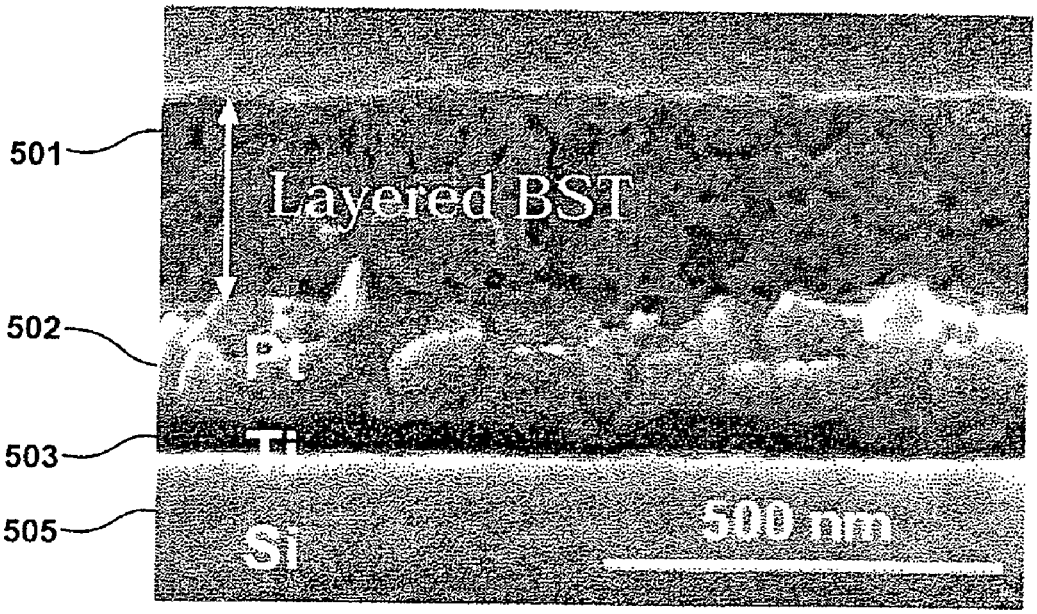
FIG. 5 is a reproduction of a cross-sectional field emission scanning electron microscope (FESEM) micrograph of a compositionally stratified BST multi-layer heterostructure material of the present invention showing abrupt substrate/BST interface and dense granular film microstructure.

Cross-sectional field emission scanning electron microscopy (FESEM) images of the inventive compositionally stratified BST multi-layer heterostructure of Example 1 are shown in FIG. 5. The FESEM micrographs demonstrate that the compositionally stratified BST multilayer heterostructure (501) possesses a dense, well-crystallized microstructure with a uniform cross-sectional thickness of ~225 nm. The multi-layered films are polycrystalline and are composed of granular multi-grains randomly distributed throughout the film thickness. The FESEM micrographs show a distinct structural delineation between the heterostructure (501) and the Pt bottom electrode (502) overlying the Ti adhesion layer (503) and Si substrate (505); and no amorphous layer or voiding/defects is observed between the heterostructure (501) and the bottom electrode (502). The FESEM images do not reveal the presence of visible internal interfaces throughout the thickness of the heterostructure (501), i.e., the heterostructure appears homogenous, lacking structural interface delineation of the internal compositional layers.

Example 5

Figure 6:
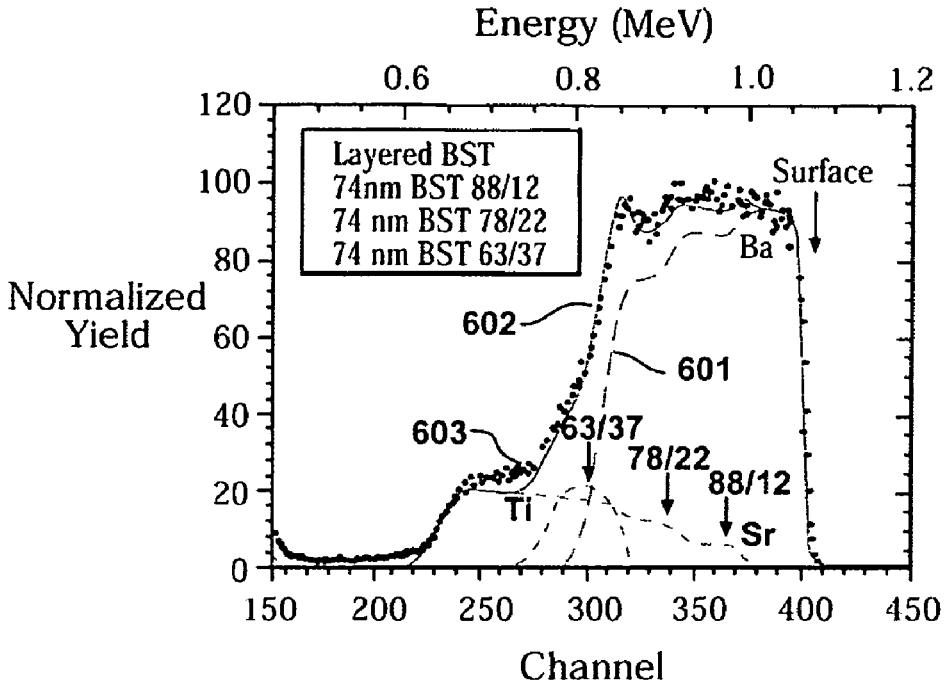
FIG. 6 is a graph of experimental RBS results for MOSD fabricated compositionally stratified BST multilayer heterostructure material crystallized at 750° C. wherein the large dashed (trace 601) and continuous smooth (trace 602) lines represent the RBS simulation via RUMP and the small dotted lines (trace 603) represent the experimental data points.

The RBS spectrum of the compositionally stratified BST multi-layer heterostructure of Example 1 is shown in FIG. 6. In order to diminish the effect of the overlap of the different elements and to accurately interpret the spectra, the RBS simulated model (trace 601 and trace 602) is compared to data collected at angles both normal to the beam (i.e., beam straight onto the sample) and then tilted away from the detector at 60° (trace 603). The RBS spectra is measured with a 1.2 MeV $He^+$ ion beam. The simulated model is found to fit both the tilted and normal spectra, thus the results are definite, accurate, and reliable. The RBS measured compositional gradients of the Ba and Sr elements in the multilayered films along the thickness direction confirm the compositional structure of the material since the compositional stratified BST multi-layer heterostructure is found to consist of three distinct compositional layers, namely, BST63/37, BST78/22, and BST88/12. The RIBS results suggest that the individual layer post deposition anneal process protocol results in negligible interdiffusion within the multi-layer heterostructure and shows that the heterostructure has three layers, each with a distinct BST nominal composition.

The RBS characterization determined the combined multi-layer heterostructure film thickness to be about 220 nm.

The room temperature dielectric response (dielectric loss, permittivity) of the material possesses enhanced dielectric response with respect to uniform composition BST. Specifically, the BST multilayer heterostructure exhibits a higher permittivity ($\in_r$=360) and lower dissipation factor (tan δ=0.012) with respect to that of the uniform composition BST60/40 film ($\in_r$=176, tan δ=0.024).

The higher permittivity in the multilayered BST heterostructure is due to the presence of the ferroelectric BST75/25 and BST90/10 layers, which possess higher permittivity (and higher tunability) with respect to uniform composition paraelectric BST60/40. The dielectric response is further improved by electrostatic interactions between layers.

The dielectric loss value, tan δ=0.012, of the inventive compositionally stratified BST multilayer heterostructure material of Example 1 is low; and in fact is a lower loss value than the single composition BST60/40 films prepared by same method on the same substrate (0.024). The lower loss of compositionally stratified BST multilayer heterostructure material with respect to uniform composition BST60/40 films results from the fact that the defects within the film are no longer mobile and are trapped at the compositionally-distinct interfaces to compensate for the polarization difference between the layers. This defect trapping at the compositional interfaces immobilizes defects such that they do not reach the electrodes, thereby allowing the film to possess an improved dielectric loss over films without this interface trapping mechanism, i.e., films which are compositionally uniform and/or continuously compositionally graded.

Device modeling results, based on Zeland Software Inc.'s IE3D full-wave simulator, utilizing a two layer stratified dielectric compositional BST thin film material demonstrated an improvement of 0.08 dB in insertion loss at Ka-band.

Example 6

Figure 7:
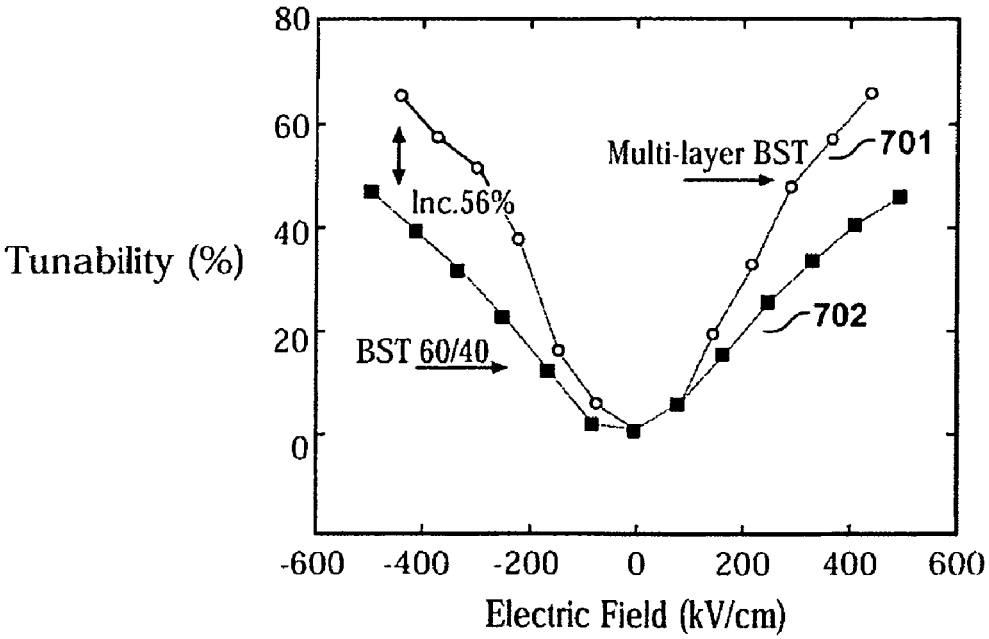
FIG. 7 is graph showing room temperature tunability results as a function of applied electric field for a compositionally stratified multi-layer BST heterostructure material (open circles-trace 701), and for uniform paraelectric BST60/40 (filled squares-trace 702) thin films.

FIG. 7 displays the room temperature tunability results as a function of applied electric field for the compositionally stratified BST multilayer heterostructure material described in Example 1 (trace 701) compared with uniform composition paraelectric BST60/40 thin films (trace 702). For both film structures the tunability increases with increasing electric field. The tighter tunability curve for the compositionally stratified BST multilayer heterostructure implies higher tuning at the same applied field with respect to the uniform composition BST60/40 film. For example, at 444 kV/cm the tunability is 65.5% for the multilayer film and 42% for the uniform composition BST film. Thus, the tunability of the compositionally stratified BST multilayer heterostructure material described in Example 1 is elevated by 56% with respect to that of the uniform composition BST film.

The compositionally heterogeneous nature and the presence of internal stresses most likely play a significant role in improving the dielectric tunability of the inventive compositionally stratified BST multilayer heterostructure material with respect to that of the uniform composition BST60/40 film. This room temperature dielectric data suggest that the compositionally stratified BST multilayer heterostructure material holds significant benefits, in terms of permittivity, loss and tunability, for tunable device elements as compared to uniform compositional BST60/40 thin films.

The higher tunability at a lower applied field of a compositionally stratified BST multilayer heterostructure material of the present invention is an important result, since in a phase shifter circuit, higher tunability allows for fewer tuning elements which are cascaded to achieve the desired phase shifting. The decrease of the amount of tuning elements directly reduces the net circuit loss. Also, fewer tuning elements directly reduce the system cost.

Example 7

Figure 8B:
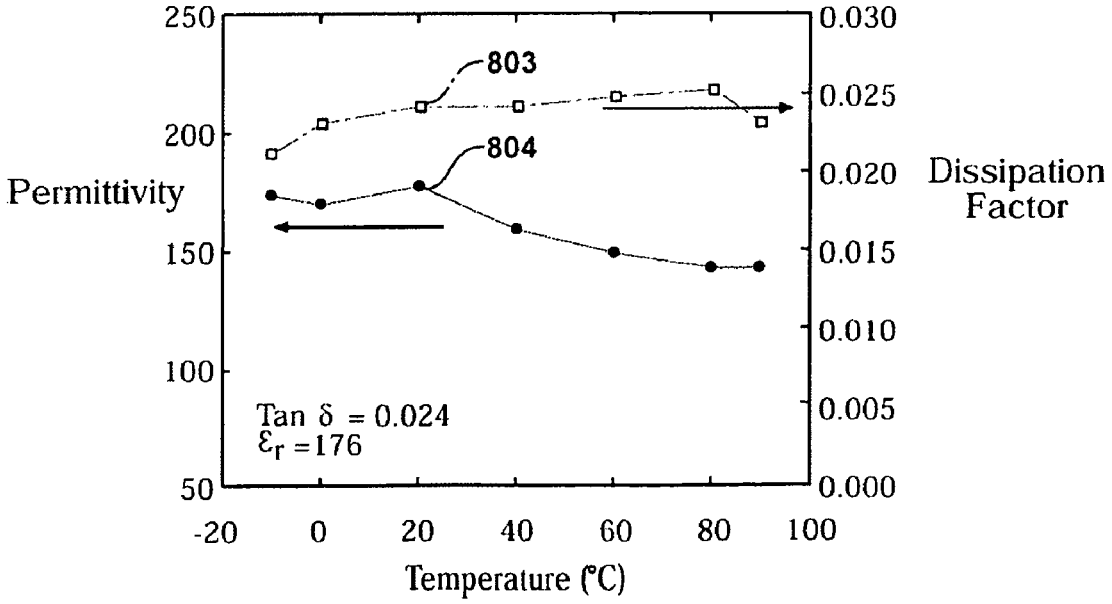
FIG. 8B is graph showing the showing the temperature dependence of the dielectric response for MOSD fabricated homogenous uniform composition paraelectric (BST60/40) BST film. Trace (803) represents the dissipation factor and trace (804) represents the permittivity.

A comparison of the temperature dependence of the dielectric response for the compositionally stratified BST multilayer heterostructure material of Example 1 and homogenous uniform composition paraelectric (BST60/40) BST film is shown in FIGS. 8A and 8B, respectively, FIG. 8A demonstrates that dissipation factor (trace 801) and the permittivity (trace 802), of the compositionally stratified EST multilayer heterostructure material exhibits minimal dispersion as a function of temperature ranging from 90 to −10° C. A compositionally stratified BST multilayer heterostructure of the present invention possesses a broader, more flat, diffuse dielectric response as a function of temperature (FIG. 8A, traces 801 and 802) when compared to that of the uniform composition paraelectric BST60/40 films (FIG. 8B), whereby trace 803 is the dissipation factor and trace 804 is the permittivity as a function of temperature. The temperature coefficient of capacitance (TCC) for the inventive compositionally stratified BST multilayer heterostructure described in Example 1 is low. The TCC is calculated from −10 to 20° C. via the equation; $TCC=\Delta C/(C_0\Delta T)$, where $\Delta C$ is the change in capacitance with respect to $C_0$ at 20° C. and $\Delta T$ is the change in temperature relative to 20° C. The compositionally stratified BST multilayer heterostructure of Example 1 exhibits a 6.4% decrease in permittivity as the temperature is elevated from 20 to 90° C. and only a 2.1 increase in permittivity as the temperature was lowered from 20 to −10° C. This small change in permittivity and low TCC value demonstrates that the inventive compositionally stratified BST multilayer heterostructure is temperature insensitive over the wide temperature range of −10 to 90° C.

The effective change in temperature coefficient of capacitance (TCC) for the inventive compositionally stratified BST multilayer heterostructure described in Example 1 with respect to uniform BST is significant; i.e., from 20 to 90° C., TCC ($TCC_{20\text{-}90}$=−0.921 ppt/° C.) was lowered by 70% with respect to the uniform composition 60/40 BST corresponding to a ~3:1 change. Similarly from 20 to −10° C. the TCC value ($TCC_{20\text{-}(10)}$=−0.716 ppt/° C.) of the multilayer BST film was lowered by 14% with respect to the uniform composition BST 60/40 film.

FIG. 8A illustrates that the dielectric loss (trace 801) of the compositionally stratified BST multilayer heterostructure of Example 1 shows negligible dispersion over the measured temperature range from −10 to 90° C.

Example 8

Figure 9:
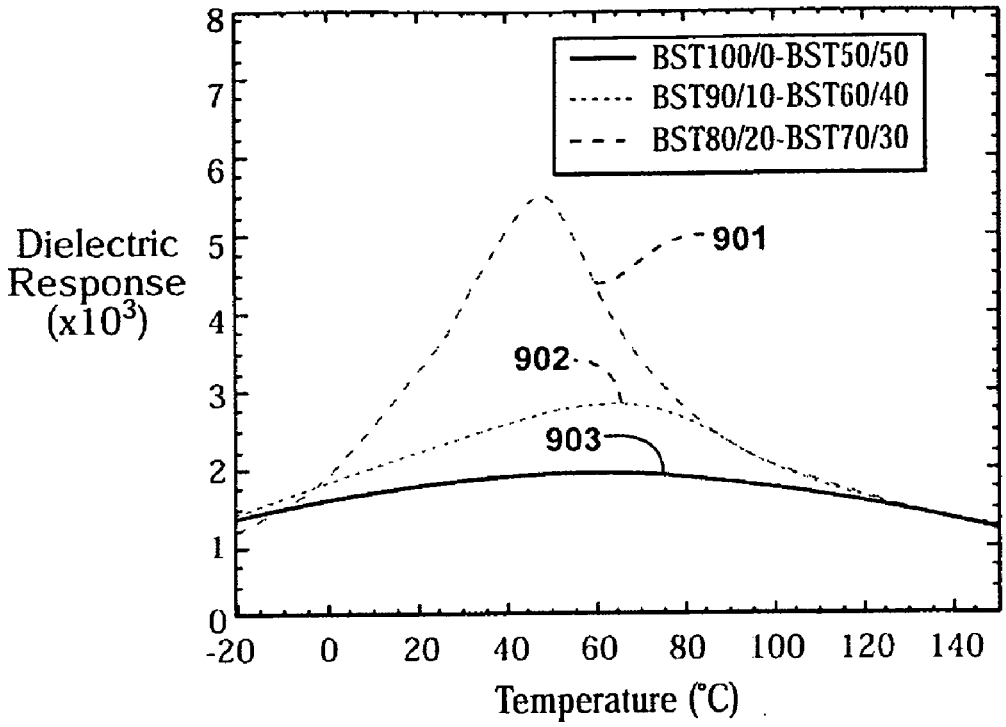
FIG. 9 is a graph showing the theoretical average dielectric response as a function of temperature for three compositionally graded $Ba_{1-x}Sr_xTiO_3$ systems with nominal average compositions of: BST 100/0 to BST 50/50 (trace 903); BST 90/10 to BST 60/40 (trace 902); and BST 80/20 to BST 70/30 (trace 901)

Theoretical modeling based on a thermodynamic analysis of compositionally graded ferroelectric materials and multilayer heterostructures is used to validate the experimental results for the compositionally stratified BST multilayer heterostructure material described herein. The thermodynamic formalism considers a single-crystal compositionally graded ferroelectric bar. It basically integrates free energies of individual layers taking into consideration the energy due to the polarization (spontaneous and induced), electrostatic coupling between layers due to the polarization difference, and the elastic interaction between layers that make up the graded heterostructure. The mechanical interaction arises from the electrostrictive coupling between the polarization and the self-strain, and consists of two components: the biaxial elastic energy due to the variation of the self-strain along the thickness and the energy associated with the bending of the ferroelectric due to the inhomogeneous elastic deformation. Based on this theory, the temperature dependence of average dielectric response of compositionally stratified BST with the same nominal compositions (BST60/40 to BST90/10) can be calculated using average thermodynamic expansion coefficients and elastic constants available in the literature as shown in FIG. 9 trace 902. In comparison to a sharp peak of the dielectric permittivity at $T_C$ for bulk homogenous ferroelectrics, a diffused dielectric response with the temperature can be expected for compositionally stratified ferroelectrics as a result of the polarization grading and interlayer interactions. It is noted that this model is developed for bulk compositionally graded ferroelectrics; however it is possible to extend it to thin films by incorporating the internal stresses due to thermal strains as well as the clamping effect of the substrate. While these factors tend to decrease the overall dielectric response compared to bulk graded structures, the temperature dependence of the dielectric permittivity displays the same trend. The maximum in the dielectric permittivity is broadened over a wide range of temperature depending on the "strength" of the composition gradient as shown in FIG. 9. A steeper composition gradient e.g. BST100/0 to BST50/50 (trace 903) will give rise to a broader maximum vs. a shallow composition gradient BST80/20 to BST70/30 (trace 901).

Example 9

The temperature dependence of the dielectric tunability for the compositionally stratified BST multilayer heterostructure material of Example 1 is shown in FIG. 10. The measured data graphed in FIG. 10 shows that, over the temperature range of −10 to 90° C., the tunability is not significantly degraded. The bias-tunability trends are temperature independent. Thus, the multilayer BST material allows antenna phase shift to be temperature stable over the ambient temperature range of −10 to 90° C.

Any patents, patent applications or publications mentioned in this specification are herein incorporated by reference to the same extent as if each individual publication was specifically and individually indicated to be incorporated by reference. U.S. Provisional Patent Application Ser. No. 60/950,041, filed Jul. 16, 2007, is incorporated herein by reference in its entirety.

Apparatus, compositions and methods are described herein to illustrate the invention. It is, therefore, to be understood that the terminology used is intended to be in the nature of words of description rather than of limitation. As will be clear to those of skill in the art, the various aspects of the present invention may be altered or combined in various ways other than those illustrated or discussed, without departing from the scope or teachings of the present invention. It should be understood that the illustrated embodiments are provided for descriptive purposes, and many variations are possible. Such changes and other uses can be made without departing frown the scope of the invention as set forth in the claims.

The invention claimed is:

1. A method of fabricating a compositionally stratified perovskite oxide multi-layer heterostructure material, comprising:

a first depositing step comprising depositing $Ba_{1-x}Sr_xTiO_3$ perovskite oxide, where x is in the range of 0.36-0.44, inclusive, on a substrate;

a first crystallizing step comprising crystallizing the $Ba_{1-x}Sr_xTiO_3$ perovskite oxide, where x is in the range of 0.36-0.44, inclusive, producing a lower layer;

a second depositing step comprising depositing $Ba_{1-x}Sr_xTiO_3$ perovskite oxide where x is in the range of 0.23-0.27, inclusive, onto the lower layer;

a second crystallizing step comprising crystallizing the $Ba_{1-x}Sr_xTiO_3$ perovskite oxide where x is in the range of 0.23-0.27, inclusive, producing an intermediate layer;

a third depositing step comprising depositing $Ba_{1-x}Sr_xTiO_3$ perovskite oxide where x in the range of 0.08-0.13, inclusive, onto the intermediate layer; and a third crystallizing step comprising crystallizing the $Ba_{1-x}Sr_xTiO_3$ perovskite oxide where x in the range of 0.08-0.13, inclusive, producing an upper layer, the upper layer having a bottom surface in contact with the intermediate layer and an opposing top surface.

2. The method of claim 1, further comprising disposing a bottom electrode on the substrate prior to deposition of the lower layer.

3. The method of claim 1, further comprising purifying the substrate prior to deposition of the lower layer.

4. The method of claim 1 wherein the first crystallizing, the second crystallizing and the third crystallizing steps each comprise thermal treatment at temperature of about 750° C. for a time of about 60 minutes, in oxygen ambience.

5. The method of claim 1, further comprising disposing a top electrode in electrical communication with the top surface of the upper layer.

6. The method of claim 1 wherein the first depositing, the second depositing and the third depositing steps each comprise metallorganic solution deposition.

* * * * *